US010801213B2

(12) United States Patent
Nilsson

(10) Patent No.: US 10,801,213 B2
(45) Date of Patent: Oct. 13, 2020

(54) SUBFLOOR JOINT

(71) Applicant: Välinge Innovation AB, Viken (SE)

(72) Inventor: Mats Nilsson, Viken (SE)

(73) Assignee: VALINGE INNOVATION AB, Viken (SE)

( * ) Notice: Subject to any disclaimer, the term of this patent is extended or adjusted under 35 U.S.C. 154(b) by 0 days.

(21) Appl. No.: 16/220,720

(22) Filed: Dec. 14, 2018

(65) Prior Publication Data

US 2019/0211568 A1 Jul. 11, 2019

(30) Foreign Application Priority Data

Jan. 10, 2018 (SE) ..... 1850029

(51) Int. Cl.
*E04F 15/02* (2006.01)

(52) U.S. Cl.
CPC .. *E04F 15/02038* (2013.01); *E04F 15/02005* (2013.01); *E04F 15/0215* (2013.01); *E04F 2201/07* (2013.01)

(58) Field of Classification Search
CPC ..... E04F 15/02038; E04F 15/02005; E04F 15/0215; E04F 2201/07
See application file for complete search history.

(56) References Cited

U.S. PATENT DOCUMENTS 213,740 A 4/1879 Connor
1,124,228 A 1/1915 Houston
1,371,856 A 3/1921 Cade
1,787,027 A 12/1930 Wasleff
1,898,364 A 2/1933 Gynn
1,925,070 A 8/1933 Livezey
1,988,201 A 1/1935 Hall
(Continued)

FOREIGN PATENT DOCUMENTS

AT 218 725 B 12/1961
CA 991373 6/1976
(Continued)

OTHER PUBLICATIONS

Search Report and Written Opinion for PCT/SE2018/051321 (12 pages). (Year: 2019).*
(Continued)

*Primary Examiner* — Rodney Mintz
(74) *Attorney, Agent, or Firm* — Buchanan Ingersoll & Rooney P.C.

(57) ABSTRACT

A set of subfloor panels including a joint configured to be glued is provided. The joint includes a tongue at a first edge of a first panel and a tongue groove at a second edge of a second panel. The tongue and the tongue groove are configured for positioning of the first panel relative to the second panel in a vertical direction, wherein a lower lip of the tongue groove extends beyond an upper lip of the tongue groove. An element protrudes from the lower lip and an underside of the first edge includes an element groove. The element and the element groove are configured for positioning of the first panel relative to the second panel in a horizontal direction. The lower lip includes a first impact surface, and the first edge includes a second impact surface. The first impact surface is configured to cooperate with the second impact surface.

11 Claims, 8 Drawing Sheets

(56) References Cited

U.S. PATENT DOCUMENTS 1,995,264 A 3/1935 Mason
2,015,813 A * 10/1935 Nielsen ..... E04F 15/04 52/390
2,044,216 A 6/1936 Klages
2,088,238 A 7/1937 Greenway
2,089,075 A 8/1937 Siebs
2,123,409 A 7/1938 Elmendorf
2,303,745 A 12/1942 Karreman
2,387,446 A 10/1945 Herz
2,430,200 A 11/1947 Wilson
2,495,862 A 1/1950 Osborn
2,740,167 A 4/1956 Rowley
2,805,852 A 9/1957 Ewert
2,894,292 A 7/1959 Gramelspacher
2,928,456 A 3/1960 Potchen et al.
3,200,553 A 8/1965 Frashour
3,204,380 A 9/1965 Smith et al.
3,259,417 A 7/1966 Chapman
3,282,010 A 11/1966 King
3,301,147 A 1/1967 Clayton
3,347,048 A 10/1967 Brown
3,387,422 A 6/1968 Wanzer
3,436,888 A 4/1969 Ottosson
3,538,665 A 11/1970 Gohner
3,553,919 A 1/1971 Omholt
3,554,850 A 1/1971 Kuhle
3,720,027 A 3/1973 Christensen
3,729,368 A 4/1973 Ingham
3,738,404 A 6/1973 Walker
3,842,562 A 10/1974 Daigle
3,859,000 A 1/1975 Webster
3,927,705 A 12/1975 Cromeens
4,028,450 A 6/1977 Gould
4,169,688 A 10/1979 Toshio
RE30,233 E 3/1980 Lane et al.
4,196,554 A 4/1980 Anderson et al.
4,426,820 A 1/1984 Terbrack et al.
4,471,012 A 9/1984 Maxwell
4,641,469 A 2/1987 Wood
4,819,932 A 4/1989 Trotter, Jr.
4,822,440 A 4/1989 Hsu et al.
4,944,514 A 7/1990 Suiter
5,029,425 A 7/1991 Bogataj
5,148,850 A 9/1992 Urbanick
5,165,816 A 11/1992 Parasin
5,216,861 A 6/1993 Meyerson
5,253,464 A 10/1993 Nilsen
5,255,726 A 10/1993 Hasegawa et al.
5,274,979 A 1/1994 Tsai
5,286,545 A 2/1994 Simmons, Jr.
5,295,341 A 3/1994 Kajiwara
5,349,796 A 9/1994 Meyerson
5,390,457 A 2/1995 Sjolander
5,474,831 A 12/1995 Nystrom
5,496,648 A 3/1996 Held
5,540,025 A 7/1996 Takehara et al.
5,560,569 A 10/1996 Schmidt
5,618,602 A 4/1997 Nelson
5,653,099 A 8/1997 MacKenzie
5,671,575 A 9/1997 Wu
5,695,875 A 12/1997 Larsson
5,706,621 A 1/1998 Pervan
5,755,068 A 5/1998 Ormiston
5,768,850 A 6/1998 Chen
5,797,237 A 8/1998 Finkell, Jr.
5,860,267 A 1/1999 Pervan
5,900,099 A 5/1999 Sweet
5,925,211 A 7/1999 Rakauskas
5,941,047 A 8/1999 Johansson
6,006,486 A 12/1999 Moriau et al.
6,021,615 A 2/2000 Brown
6,023,907 A 2/2000 Pervan
6,029,416 A 2/2000 Andersson
6,101,778 A 8/2000 Martensson
6,134,854 A 10/2000 Stanchfield
6,139,945 A 10/2000 Krejchi et al.
6,148,884 A 11/2000 Bolyard et al.
6,182,410 B1 2/2001 Pervan
6,205,639 B1 3/2001 Pervan
6,209,278 B1 4/2001 Tychsen
6,216,409 B1 4/2001 Roy et al.
6,247,285 B1 6/2001 Moebus
6,324,803 B1 12/2001 Pervan
6,324,809 B1 12/2001 Nelson
6,332,733 B1 12/2001 Hamberger et al.
6,345,481 B1 2/2002 Nelson
6,363,677 B1 4/2002 Chen et al.
6,385,936 B1 5/2002 Schneider
6,421,970 B1 7/2002 Martensson
6,446,405 B1 9/2002 Pervan
6,490,836 B1 12/2002 Moriau et al.
6,497,079 B1 12/2002 Pletzer et al.
6,505,452 B1 1/2003 Hannig et al.
6,510,665 B2 1/2003 Pervan
6,516,579 B1 2/2003 Pervan
6,521,314 B2 2/2003 Tychsen
6,532,709 B2 3/2003 Pervan
6,536,178 B1 3/2003 Palsson et al.
6,584,747 B2 7/2003 Kettler et al.
6,591,568 B1 7/2003 Palsson
6,601,359 B2 8/2003 Olofsson
6,606,834 B2 8/2003 Martensson et al.
6,617,009 B1 9/2003 Chen et al.
6,647,689 B2 11/2003 Pletzer et al.
6,647,690 B1 11/2003 Martensson
6,682,254 B1 1/2004 Olofsson et al.
6,695,944 B2 2/2004 Courtney
6,711,869 B2 3/2004 Tychsen
6,715,253 B2 4/2004 Pervan
6,729,091 B1 5/2004 Martensson
6,769,218 B2 8/2004 Pervan
6,769,219 B2 8/2004 Schwitte et al.
6,772,568 B2 8/2004 Thiers et al.
6,786,019 B2 9/2004 Thiers
6,804,926 B1 10/2004 Eisermann
6,851,237 B2 2/2005 Niese et al.
6,851,241 B2 2/2005 Pervan
6,862,857 B2 * 3/2005 Tychsen ..... E04F 15/02 52/582.1
6,874,292 B2 4/2005 Moriau et al.
6,880,305 B2 4/2005 Pervan et al.
6,880,307 B2 4/2005 Schwitte et al.
6,898,911 B2 5/2005 Kornfalt et al.
6,898,913 B2 5/2005 Pervan
6,918,220 B2 7/2005 Pervan
6,922,964 B2 8/2005 Pervan
6,922,965 B2 8/2005 Rosenthal et al.
6,955,020 B2 10/2005 Moriau et al.
6,966,963 B2 11/2005 O'Connor
7,003,925 B2 2/2006 Pervan
7,040,068 B2 5/2006 Moriau et al.
7,051,486 B2 5/2006 Pervan
7,055,290 B2 6/2006 Thiers
7,086,205 B2 8/2006 Pervan
D528,671 S 9/2006 Grafenauer
7,121,058 B2 10/2006 Palsson et al.
7,121,059 B2 10/2006 Pervan
7,127,860 B2 10/2006 Pervan et al.
7,131,242 B2 11/2006 Martensson et al.
RE39,439 E 12/2006 Pervan
7,169,460 B1 1/2007 Chen
7,171,791 B2 2/2007 Pervan
7,251,916 B2 8/2007 Konzelmann et al.
7,275,350 B2 10/2007 Pervan et al.
7,328,536 B2 2/2008 Moriau et al.
7,356,971 B2 4/2008 Pervan
7,386,963 B2 6/2008 Pervan
7,398,625 B2 7/2008 Pervan
7,441,384 B2 10/2008 Miller et al.
7,441,385 B2 10/2008 Palsson et al.
7,444,791 B1 11/2008 Pervan
7,484,338 B2 2/2009 Pervan
7,506,481 B2 * 3/2009 Grafenauer ..... E04B 5/12 52/592.1

(56) References Cited

U.S. PATENT DOCUMENTS 7,516,588 B2 4/2009 Pervan
7,568,322 B2 8/2009 Pervan et al.
7,596,920 B2 10/2009 Konstanczak
7,603,826 B1 10/2009 Moebus
7,617,651 B2 11/2009 Grafenauer
7,632,561 B2 12/2009 Thiers
7,762,293 B2 7/2010 Pervan
7,775,007 B2 8/2010 Pervan
7,779,596 B2 8/2010 Pervan
7,823,359 B2 11/2010 Pervan
7,845,133 B2 12/2010 Pervan
7,856,784 B2 12/2010 Martensson
7,856,785 B2 12/2010 Pervan
7,856,789 B2 12/2010 Eisermann
7,874,119 B2 1/2011 Pervan
7,886,497 B2 2/2011 Pervan et al.
7,913,471 B2 3/2011 Pervan
7,954,295 B2 6/2011 Pervan
8,011,155 B2 9/2011 Pervan
8,021,741 B2 9/2011 Chen et al.
8,033,075 B2 10/2011 Pervan
8,071,193 B2 12/2011 Windmoller
8,215,076 B2 7/2012 Pervan et al.
8,234,829 B2 8/2012 Thiers et al.
8,234,831 B2 8/2012 Pervan
8,293,058 B2 10/2012 Pervan et al.
8,353,140 B2 1/2013 Pervan et al.
8,356,452 B2 1/2013 Thiers et al.
8,429,869 B2 4/2013 Pervan
8,495,849 B2 7/2013 Pervan
8,590,253 B2 11/2013 Pervan
8,591,691 B2 11/2013 Wallin
8,613,826 B2 12/2013 Pervan et al.
8,615,955 B2 12/2013 Pervan et al.
8,658,274 B2 2/2014 Chen et al.
8,689,512 B2 4/2014 Pervan
8,733,410 B2 5/2014 Pervan
8,763,340 B2 7/2014 Pervan et al.
8,826,622 B2 9/2014 Cappelle et al.
8,869,486 B2 10/2014 Pervan
9,322,183 B2 4/2016 Pervan
9,528,276 B2 12/2016 Pervan
9,567,753 B2 2/2017 Pervan et al.
9,605,436 B2 3/2017 Pervan et al.
9,695,851 B2 * 7/2017 Hannig ..... E04F 15/02038
9,970,199 B2 5/2018 Pervan et al.
10,138,637 B2 11/2018 Pervan
2002/0007608 A1 1/2002 Pervan
2002/0007609 A1 1/2002 Pervan
2002/0014047 A1 2/2002 Thiers
2002/0020127 A1 2/2002 Thiers et al.
2002/0046433 A1 4/2002 Sellman et al.
2002/0046528 A1 4/2002 Pervan et al.
2002/0056245 A1 5/2002 Thiers
2002/0083673 A1 7/2002 Kettler et al.
2002/0092263 A1 7/2002 Schulte
2002/0095894 A1 7/2002 Pervan
2002/0112429 A1 8/2002 Niese et al.
2002/0112433 A1 8/2002 Pervan
2002/0170257 A1 11/2002 McLain et al.
2002/0178673 A1 12/2002 Pervan
2002/0178674 A1 12/2002 Pervan
2002/0178682 A1 12/2002 Pervan
2003/0024200 A1 2/2003 Moriau et al.
2003/0029116 A1 2/2003 Moriau et al.
2003/0033777 A1 2/2003 Thiers et al.
2003/0033784 A1 2/2003 Pervan
2003/0079820 A1 5/2003 Palsson et al.
2003/0084636 A1 5/2003 Pervan
2003/0101674 A1 6/2003 Pervan et al.
2003/0101681 A1 * 6/2003 Tychsen ..... E04F 15/02
52/783.1
2003/0115812 A1 6/2003 Pervan
2003/0115821 A1 6/2003 Pervan
2003/0140478 A1 7/2003 Olofsson
2003/0154676 A1 8/2003 Schwartz
2003/0154681 A1 8/2003 Pletzer
2003/0196397 A1 10/2003 Niese et al.
2003/0196405 A1 10/2003 Pervan
2004/0016196 A1 1/2004 Pervan
2004/0031225 A1 2/2004 Fowler
2004/0035078 A1 2/2004 Pervan
2004/0068954 A1 4/2004 Martensson
2004/0107659 A1 6/2004 Glockl
2004/0123547 A1 7/2004 Grafenauer
2004/0139678 A1 7/2004 Pervan
2004/0211144 A1 10/2004 Stanchfield
2004/0241374 A1 12/2004 Thiers
2005/0016107 A1 1/2005 Rosenthal et al.
2005/0034404 A1 2/2005 Pervan
2005/0034405 A1 2/2005 Pervan
2005/0055943 A1 3/2005 Pervan
2005/0102937 A1 5/2005 Pervan
2005/0144878 A1 * 7/2005 Grafenauer ..... E04B 5/12
52/578
2005/0166502 A1 8/2005 Pervan
2005/0166514 A1 8/2005 Pervan
2005/0166516 A1 8/2005 Pervan
2005/0193677 A1 9/2005 Vogel
2005/0208255 A1 9/2005 Pervan
2005/0210810 A1 9/2005 Pervan
2005/0268570 A2 12/2005 Pervan
2006/0032168 A1 2/2006 Thiers
2006/0075713 A1 4/2006 Pervan et al.
2006/0117696 A1 6/2006 Pervan
2006/0162851 A1 7/2006 Engel
2006/0196139 A1 9/2006 Pervan
2006/0283127 A1 12/2006 Pervan
2007/0011981 A1 1/2007 Eisermann
2007/0119110 A1 5/2007 Pervan
2007/0175143 A1 8/2007 Pervan et al.
2007/0175144 A1 8/2007 Hakansson
2007/0175148 A1 8/2007 Bergelin et al.
2007/0175156 A1 8/2007 Pervan et al.
2008/0000179 A1 1/2008 Pervan
2008/0000180 A1 1/2008 Pervan
2008/0000182 A1 1/2008 Pervan
2008/0000186 A1 1/2008 Pervan
2008/0000187 A1 1/2008 Pervan
2008/0000188 A1 1/2008 Pervan
2008/0000189 A1 1/2008 Pervan et al.
2008/0000194 A1 1/2008 Pervan
2008/0000417 A1 1/2008 Pervan et al.
2008/0005989 A1 1/2008 Pervan et al.
2008/0005992 A1 1/2008 Pervan
2008/0005997 A1 1/2008 Pervan
2008/0005998 A1 1/2008 Pervan
2008/0005999 A1 1/2008 Pervan
2008/0008871 A1 1/2008 Pervan
2008/0010931 A1 1/2008 Pervan
2008/0010937 A1 1/2008 Pervan
2008/0028707 A1 2/2008 Pervan
2008/0028713 A1 2/2008 Pervan
2008/0034701 A1 2/2008 Pervan
2008/0034708 A1 2/2008 Pervan
2008/0041007 A1 2/2008 Pervan et al.
2008/0041008 A1 2/2008 Pervan
2008/0060308 A1 3/2008 Pervan
2008/0066415 A1 3/2008 Pervan et al.
2008/0104921 A1 5/2008 Pervan et al.
2008/0110125 A1 5/2008 Pervan
2008/0134607 A1 6/2008 Pervan et al.
2008/0134613 A1 6/2008 Pervan et al.
2008/0134614 A1 6/2008 Pervan et al.
2008/0138560 A1 6/2008 Windmoller
2008/0168737 A1 7/2008 Pervan
2008/0172971 A1 7/2008 Pervan
2008/0241440 A1 * 10/2008 Bauer ..... E04F 15/02
428/33
2009/0151291 A1 6/2009 Pervan
2010/0229491 A1 9/2010 Pervan
2010/0275546 A1 11/2010 Pervan
2011/0041996 A1 2/2011 Pervan
2011/0072754 A1 3/2011 Pervan et al.

(56) References Cited

U.S. PATENT DOCUMENTS

| | | | | |
|---|---|---|---|---|
| 2011/0146188 | A1 | 6/2011 | Wallin | |
| 2011/0203214 | A1 | 8/2011 | Pervan | |
| 2011/0209430 | A1 | 9/2011 | Pervan | |
| 2011/0296780 | A1 | 12/2011 | Windmoller | |
| 2012/0216472 | A1 | 8/2012 | Martensson | |
| 2012/0233953 | A1 | 9/2012 | Pervan et al. | |
| 2012/0266555 | A1 | 10/2012 | Cappelle | |
| 2013/0014890 | A1 | 1/2013 | Pervan et al. | |
| 2013/0097959 | A1* | 4/2013 | Michel | E04F 15/02 52/588.1 |
| 2013/0219820 | A1 | 8/2013 | Pervan | |
| 2013/0309441 | A1* | 11/2013 | Hannig | E04F 15/02038 428/100 |
| 2014/0020325 | A1 | 1/2014 | Pervan | |
| 2014/0090331 | A1 | 4/2014 | Pervan et al. | |
| 2014/0115994 | A1 | 5/2014 | Pervan | |
| 2014/0283466 | A1* | 9/2014 | Boo | E04F 15/02038 52/105 |
| 2015/0027080 | A1 | 1/2015 | Pervan | |
| 2015/0267418 | A1* | 9/2015 | Vermeulen | E04F 15/02038 52/582.2 |
| 2016/0201338 | A1 | 7/2016 | Pervan | |
| 2017/0073977 | A1 | 3/2017 | Huang | |
| 2017/0342725 | A1 | 11/2017 | Pervan et al. | |

FOREIGN PATENT DOCUMENTS

| | | | | |
|---|---|---|---|---|
| CA | 2 363 184 | A1 | 7/2001 | |
| DE | 1 212 275 | | 3/1966 | |
| DE | 2 159 042 | | 6/1973 | |
| DE | 26 16 077 | A1 | 10/1977 | |
| DE | 30 41 781 | A1 | 6/1982 | |
| DE | 33 43 601 | A1 | 6/1985 | |
| DE | 33 43 601 | C2 | 6/1985 | |
| DE | 35 38 538 | A1 | 5/1987 | |
| DE | 39 18 676 | A1 | 8/1990 | |
| DE | 41 30 115 | A1 | 3/1993 | |
| DE | 42 42 530 | A1 | 6/1994 | |
| DE | 299 22 649 | U1 | 3/2000 | |
| DE | 200 01 225 | U1 | 7/2000 | |
| DE | 200 13 380 | U1 | 11/2000 | |
| DE | 199 25 248 | A1 | 12/2000 | |
| DE | 203 07 580 | U1 | 7/2003 | |
| DE | 102 24 540 | A1 | 12/2003 | |
| DE | 103 16 695 | A1 | 10/2004 | |
| DE | 10 2005 039 369 | A1 | 2/2007 | |
| EP | 0 220 389 | A2 | 5/1987 | |
| EP | 0 623 724 | A1 | 11/1994 | |
| EP | 0 652 340 | A1 | 5/1995 | |
| EP | 0 849 416 | A2 | 6/1998 | |
| EP | 0 976 889 | A1 | 2/2000 | |
| EP | 1 045 083 | A1 | 10/2000 | |
| EP | 1 045 083 | B1 | 10/2002 | |
| EP | 1 317 983 | A2 | 6/2003 | |
| EP | 1 317 983 | A3 | 6/2003 | |
| EP | 1 353 023 | A2 | 10/2003 | |
| EP | 2 516 768 | | 6/2011 | |
| FR | 1293043 | A | 4/1962 | |
| FR | 2 128 182 | A1 | 10/1972 | |
| FR | 2 675 174 | A1 | 10/1992 | |
| GB | 812671 | | 4/1959 | |
| GB | 1 430 423 | A | 3/1976 | |
| GB | 2 117 813 | | 10/1983 | |
| GB | 2 256 023 | A | 11/1992 | |
| IT | MO20090228 | A1 * | 3/2011 | E04F 15/085 |
| JP | H01-178659 | A | 7/1989 | |
| JP | H03-169967 | A | 7/1991 | |
| JP | H06-320510 | A | 11/1994 | |
| JP | H07-180333 | A | 7/1995 | |
| JP | H07-300979 | A | 11/1995 | |
| JP | H07-310426 | A | 11/1995 | |
| JP | H08-109734 | A | 4/1996 | |
| JP | H10-219975 | A | 8/1998 | |
| JP | 2000-179137 | A | 6/2000 | |
| KR | 1996-0005785 | | 7/1996 | |
| SE | 372 051 | B | 12/1974 | |
| SE | 502 994 | C2 | 3/1996 | |
| WO | WO 84/02155 | A1 | 6/1984 | |
| WO | WO 92/17657 | A1 | 10/1992 | |
| WO | WO 93/13280 | A1 | 7/1993 | |
| WO | WO 94/26999 | A1 | 11/1994 | |
| WO | WO 96/27719 | A1 | 9/1996 | |
| WO | WO 97/47834 | A1 | 12/1997 | |
| WO | WO 98/24994 | A1 | 6/1998 | |
| WO | WO 98/24995 | A1 | 6/1998 | |
| WO | WO 98/38401 | A1 | 9/1998 | |
| WO | WO 99/66151 | A1 | 12/1999 | |
| WO | WO 99/66152 | A1 | 12/1999 | |
| WO | WO 00/66856 | A1 | 11/2000 | |
| WO | WO 01/44669 | A2 | 6/2001 | |
| WO | WO 01/44669 | A3 | 6/2001 | |
| WO | WO 01/75247 | A1 | 10/2001 | |
| WO | WO 02/092342 | A1 | 11/2002 | |
| WO | WO 03/012224 | A1 | 2/2003 | |
| WO | WO 03/025307 | A1 | 3/2003 | |
| WO | WO 03/078761 | A1 | 9/2003 | |
| WO | WO 2004/108436 | A2 | 12/2004 | |
| WO | WO 2012/001503 | A1 | 1/2012 | |

OTHER PUBLICATIONS

Correspondence from Bütec cited during opposition procedure at EPO in DE Patent No. 3343601, including announcement of Oct. 1984 re "Das Festprogram von Bütec: Mehrzweckbühnen, tanzplatten, Schonbeläge, Tanzbeläge, Bestuhlung"; letter of Nov. 7, 2001 to Perstorp Support AB with attached brochure published Oct. 1984 and installation instructions published Nov. 1984; and letter of Nov. 19, 2001 to Perstorp Support AB, 6 pages.

Drawing Figure 25/6107 From Buetec GmbH dated Dec. 16, 1985, 1 page.

* cited by examiner

SUBFLOOR JOINT

CROSS REFERENCE TO RELATED APPLICATIONS

The present application claims the benefit of Swedish Application No. 1850029-8, filed on Jan. 10, 2018. The entire contents of Swedish Application No. 1850029-8 are hereby incorporated herein by reference in their entirety.

TECHNICAL FIELD

Embodiments of the present invention relate to subfloor panels comprising a joint. The panels are configured to be assembled on joists. The panels and the joists may be wood based.

BACKGROUND

Subfloors are known comprising wood based panels, such as particle boards, comprising tongue and groove joints which are configured to be glued.

Embodiments of the present invention address a need to provide an improved subfloor and joint.

SUMMARY

Accordingly, embodiments of the present invention preferably seek to mitigate, alleviate or eliminate one or more deficiencies, disadvantages or issues in the art, such as the above-identified, singly or in any combination by providing subfloor panels comprising a joint which enables a faster assembling of the subfloor panels.

Another embodiment of the invention is to provide subfloor panels with a joint with increased strength.

At least some of these and other objects and advantages that will become apparent from the description have been achieved by an aspect of the invention that includes a set of essentially identical subfloor panels comprising a joint configured to be glued. The joint comprising a tongue at a first edge of a first panel and a tongue groove at a second edge of a second panel. The tongue and the tongue groove are configured for positioning of the first panel relative the second panel in a vertical direction. A lower lip of the tongue groove extends beyond an upper lip of the tongue groove. An element protrudes from the lower lip and an underside of the first edge comprising an element groove. The element and the element groove are configured for positioning of the first panel relative to the second panel in a horizontal direction. An outer edge of the lower lip comprises a first impact surface, which is downward facing, and the first edge comprises a second impact surface, which is upward facing. The first impact surface is configured to cooperate with the second impact surface for partly absorbing a force applied at an upper surface of the first panel and/or at an upper surface of a second panel when the first and the second panel are joined by the joint and assembled on joists.

Thus, the joint solves the problem of positioning the first panel relative to the second panel before the glue dries or cures and bonds the first panel to the second panel.

The impact surfaces may have the effect that the strength of the joint is improved.

A lower surface of the tongue may be configured to be positioned at a distance from an upper surface of the lower lip, in a joined position of the first and the second panel such that a glue space is obtained.

The glue space may extend essentially from the element to an outer part of the tongue.

The distance between the lower surface of the tongue and the upper surface of the lower lip may be in the range of about 0.2 mm to about 0.5 mm, preferably about 0.3 mm.

An angle between the second impact surface and a lower surface of the first panel may be in the range of about 40° to about 70°, preferably about 60°.

The first impact surface may be essentially parallel to the second impact surface.

The panels may be wood based panels, such as particleboard, OSB, plywood, HDF or MDF.

The first and the second panel may each comprise outer layers and a core layer, wherein the core layer comprises particles that are coarser than the outer layers, wherein the lower surface of the tongue and the upper surface of the lower lip are within the core layer, such that a stronger glue connection is obtained.

The first and the second panel may each comprise outer layers and a core layer, wherein the core layer comprises particles that are coarser than the outer layers, wherein an upper surface of the tongue is configured to be glued to a lower surface of the upper lip, wherein the upper surface of the tongue and lower surface of the upper lip, are within the core layer, such that a stronger glue connection is obtained.

The first impact surface and the second impact surface may be configured to be glued together.

The joint may be configured for a joining of the first edge and the second edge by an angling motion of the first panel relative to the second panel.

BRIEF DESCRIPTION OF THE DRAWINGS

These and other aspects, features and advantages of which embodiments of the invention are capable of, will be apparent and elucidated from the following description of embodiments of the present invention, reference being made to the accompanying drawings, in which.

DETAILED DESCRIPTION OF EMBODIMENTS

Figure 1A:
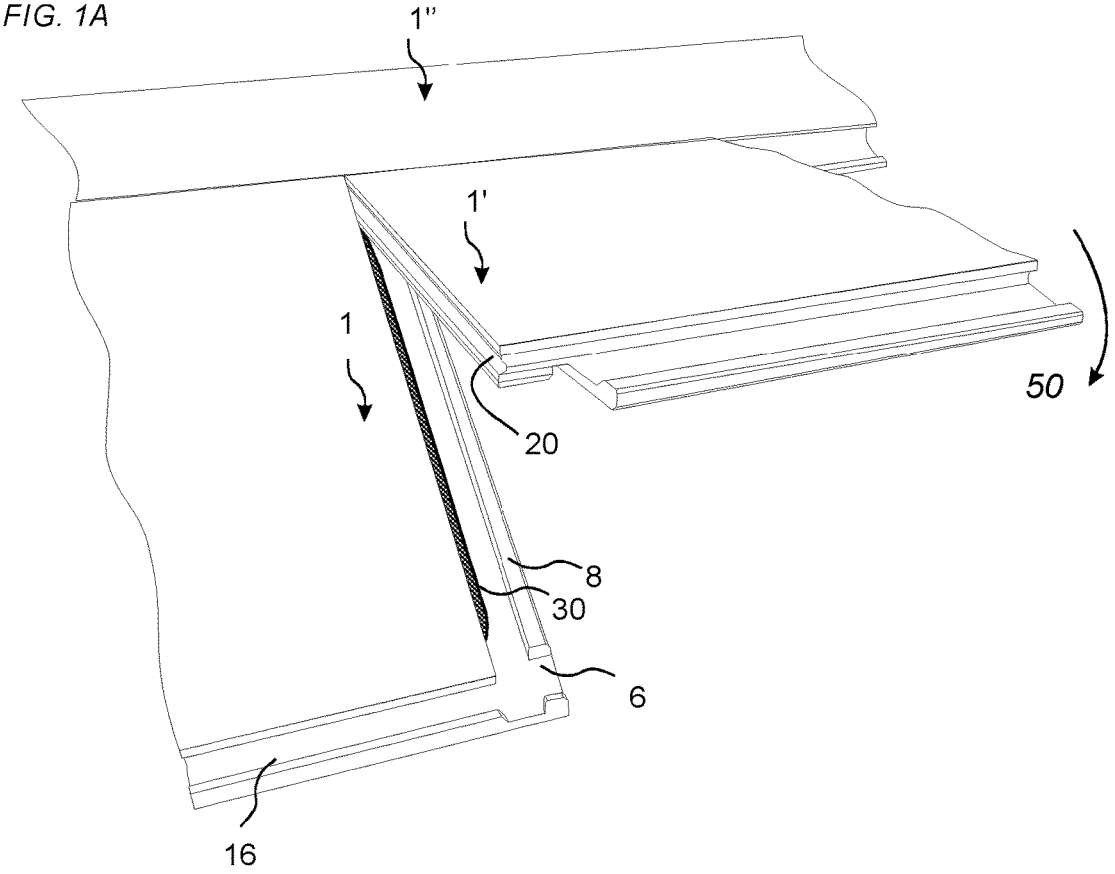
FIG. 1A shows in a 3D-view an embodiment of the set of subfloor panels according to an embodiment of the invention.

Specific embodiments of the invention will now be described with reference to the accompanying drawings.

This invention may, however, be embodied in many different forms and should not be construed as limited to the embodiments set forth herein; rather, these embodiments are provided so that this disclosure will be thorough and complete, and will fully convey the scope of the invention to those skilled in the art. The terminology used in the detailed description of the embodiments illustrated in the accompanying drawings is not intended to limit the invention. In the drawings, like numbers refer to like elements. When the word "about" is used in this specification in connection with a numerical value, it is intended that the associated numerical value include a tolerance of +/−10% around the stated numerical value.

Figure 1B:
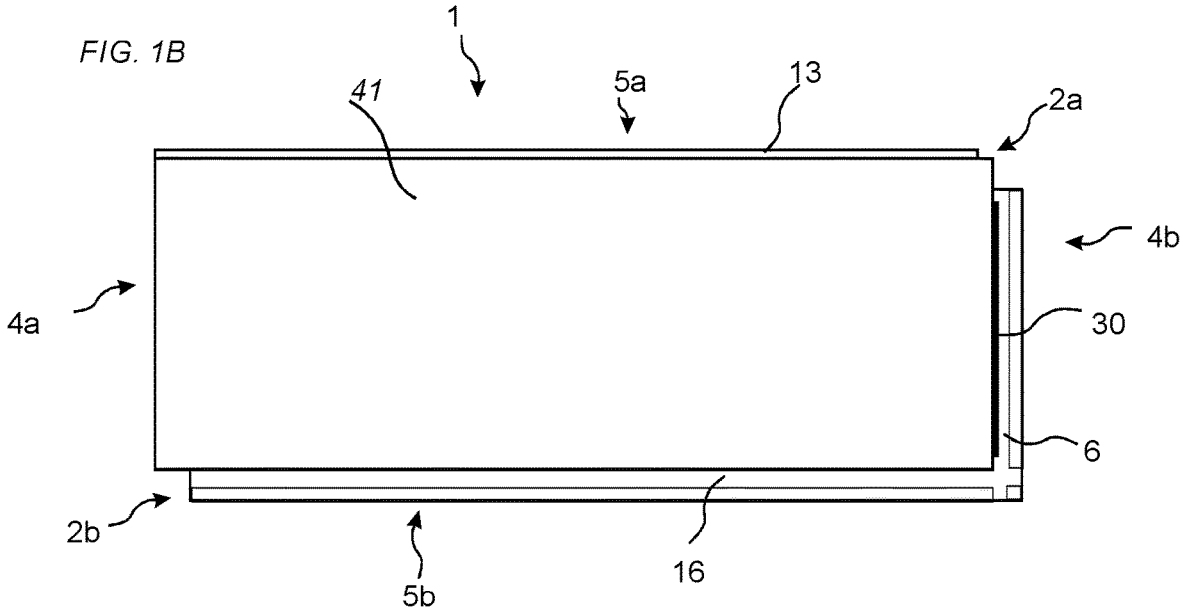
FIG. 1B shows in a top view an embodiment of a subfloor panel according to an embodiment of the invention.

An embodiment of the invention is shown in FIG. 1A in a 3D-view during assembling of a set of subfloor panels. The subfloor panels are essentially identical. An embodiment of a panel 1 in the set is shown in FIG. 1B. The panel 1 is of a rectangular shape and comprises a first edge 5*a* and an opposite second edge 5*b*. The panel 1 further comprises a third edge 4*a* and an opposite fourth edge 4*b* which extend between the first edge 5*a* and the opposite second edge 5*b*. The first and the second edge may be long edges and the third and the fourth edge may be short edges. The panel 1 comprises an upper surface 41 and at least two opposite edges comprise a joint for joining the panel 1 to an adjacent panel. FIG. 1A shows that a first edge 5*a* of a first panel 1' may be joined to a second edge 5*b* of a second panel 1" by an angling motion 50 and a third edge 4*a* of the first panel 1' may be joined by the same angling motion to a fourth edge 4*b* of a third panel 1.

Figure 2:
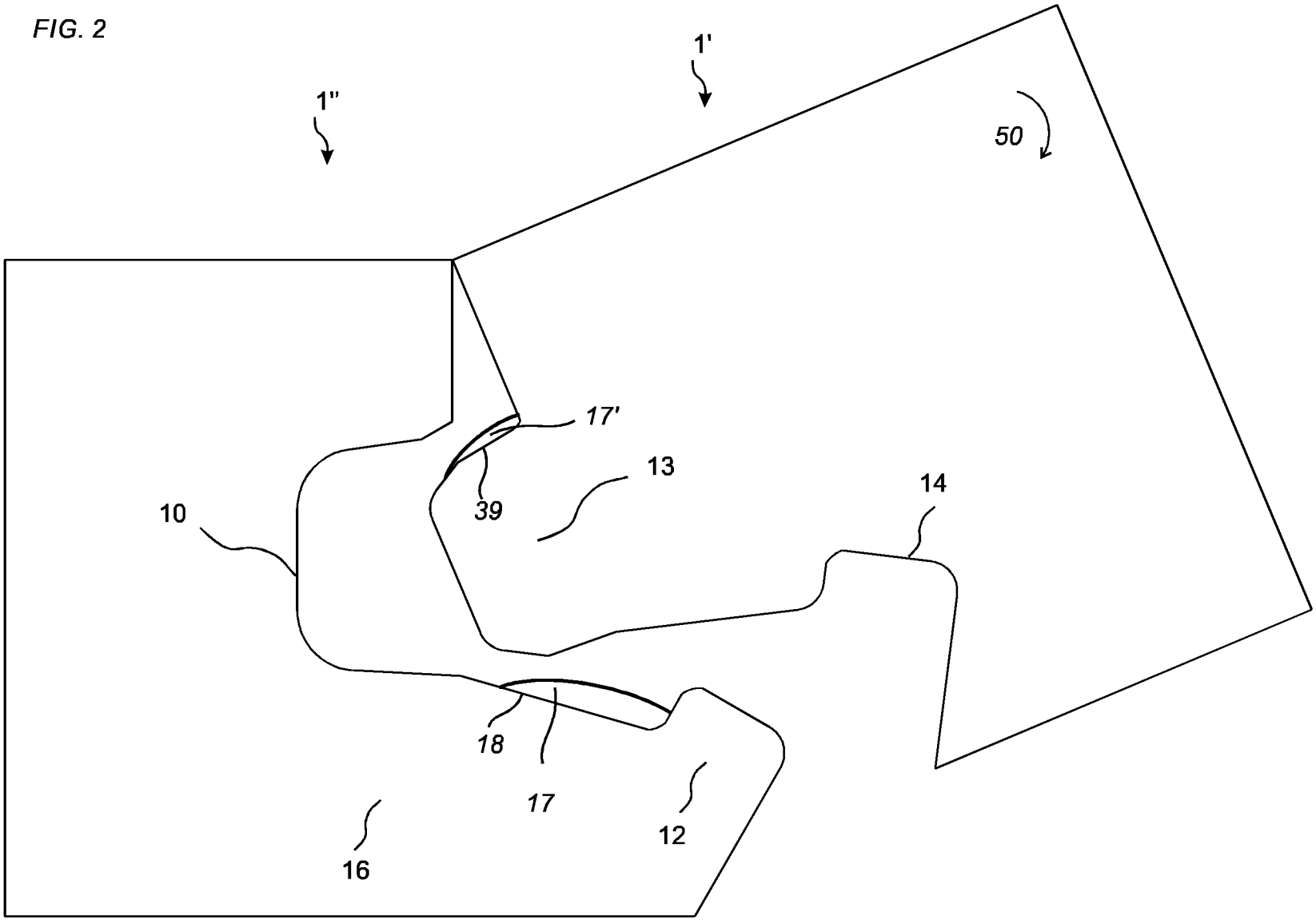
FIG. 2 shows a crosscut in a side view of an embodiment of the set of subfloor panels during joining according to an embodiment of the invention.
Figure 3:
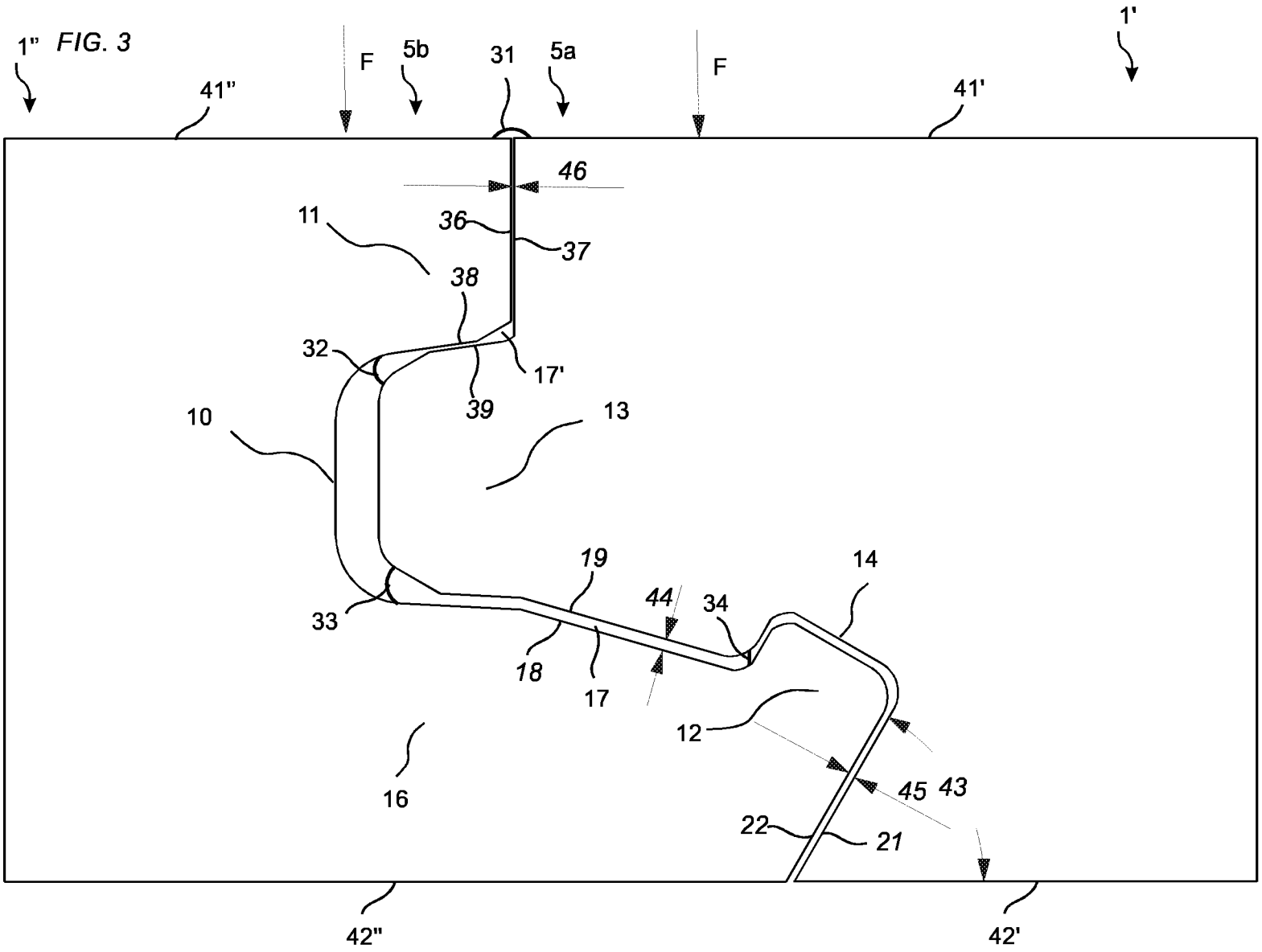
FIG. 3 shows a crosscut in a side view of an embodiment of the set of subfloor panels in a joined position according to an embodiment of the invention.
Figure 4:
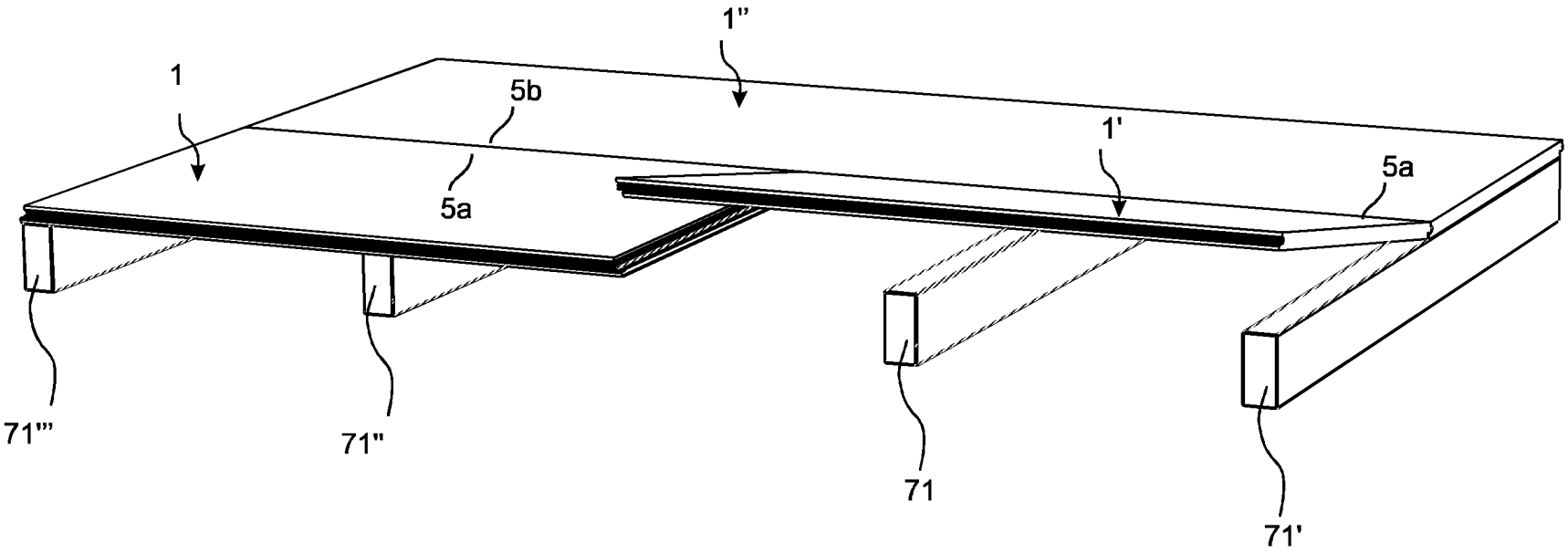
FIG. 4 shows in a 3D-view an embodiment of the set of subfloor panels during joining on joists according to an embodiment of the invention.

FIG. 2 shows a crosscut in a side view of an embodiment of the set of subfloor panels during joining and FIG. 3 shows the embodiment in a joined position. The set comprises a joint configured to be glued. The joint comprises a tongue 13 at a first edge 5*a* of a first panel 1' and a tongue groove 10 at a second edge 5*b* of a second panel 1". The tongue 13 and the tongue groove 10 are configured for positioning of the first panel 1' relative to the second panel 1" in a vertical direction. A lower lip 16 of the tongue groove 10 extends beyond an upper lip 11 of the tongue groove 10. An element 12 protrudes from the lower lip 16 and an underside of the first edge 5*a* comprises an element groove 14, wherein the element and the element groove are configured for positioning of the first panel 1' relative to the second panel 1" in a horizontal direction. An outer edge of the lower lip 16 comprises a first impact surface 22, which is downward facing, and the first edge 5*a* comprises a second impact surface 21, which is upward facing. The first impact surface 22 is configured to cooperate with the second impact surface 21 for partly absorbing a force F applied at an upper surface 41' of the first panel 1' and/or at an upper surface 41" of the second panel 1" when the first and the second panel are joined by the joint and assembled on joists 71, 71' as shown in FIG. 4.

FIG. 2 shows that glue 17, 17' may be applied on an upper surface 39 of the tongue 13 and on an upper surface 18 of the lower lip 16 before the first and the second panel are joined. Furthermore, glue may be applied on the first impact surface 22 and/or on the second impact surface 21 (not shown) before the first and the second panel are joined. The glue is, during the joining, distributed in parts of the joint. A portion of the glue may be positioned, in the joined positioned, at the upper surface 41' of the first panel 1' and/or second panel. That portion of the glue is preferably removed before the glue has dried or hardened.

The glue 17' applied on the upper surface 39 of the tongue 13 may be distributed from an inner part 32 at the tip of the tongue 13 to an outer part 31 at the upper surface 41',41" of the first panel 1' and/or second panel 1".

The joint may comprise a first joint surface 37 at the first edge 5*a* and an opposite second joint surface 36 at the second edge 5*b*. The first joint surface 37 extends from the upper surface 41' of the first panel 1' towards the tongue 13. The second joint surface 36 extends from the upper surface 41" of the second panel 1' towards the tongue groove 10. The first joint surface 37 and the opposite second joint surface 36 are configured to be glued to each other. The glue 17' applied on the upper surface 39 of the tongue 13 may be distributed between the first joint surface 37 and the opposite second joint surface 36.

A distance 46 between the first joint surface 37 and the second joint surface 36 may be in the range of about 0.05 mm to about 0.3 mm, or in the range of about 0.1 mm to about 0.2 mm, or about 0.15 mm.

The glue 17 applied on the upper surface 18 of the lower lip 16 may be distributed from an inner part 33 at the tip of the tongue 13 to an outer part 34 at the element 12.

The glue may be a resin, preferably cross-linked, hot melt glue, white glue or glue comprising polyvinyl acetate or polyurethane.

A lower surface 19 of the tongue 13 may be configured to be positioned at a distance 44 from an upper surface 18 of the lower lip 16, in a joined position of the first and the second panel 1', 1", such that a glue space is obtained. The glue space may extend essentially from the element 12 to an outer part of the tongue 13. The distance 44 between the lower surface 19 of the tongue 13 and the upper surface 18 of the lower lip 16, may be in the range of about 0.2 mm to about 0.5 mm, preferably about 0.3 mm.

A distance between the upper surface 39 of the tongue 13 and the lower surface 38 of the upper lip 11, may be shorter than the distance 44 between the lower surface 19 of the tongue 13 and the upper surface 18 of the lower lip 16.

An angle 43 between the second impact surface and a lower surface 42' of the first panel 1' may be in the range of about 40° to about 70°, preferably about 60°.

The first impact surface 22 may be essentially parallel to the second impact surface 21.

The first impact surface 22 and the second impact surface 21 may have a planar and/or curved shape.

The first impact surface 22 and the second impact surface 21 may have the same shape.

A distance 45 between the first impact surface 22 and the second impact surface 21 may be in the range of about 0.05 mm to about 0.3 mm, or in the range of about 0.1 mm to about 0.2 mm, or about 0.15 mm.

The panels may be wood based panels, such as particleboard, OSB, plywood, HDF or MDF.

Figure 8:
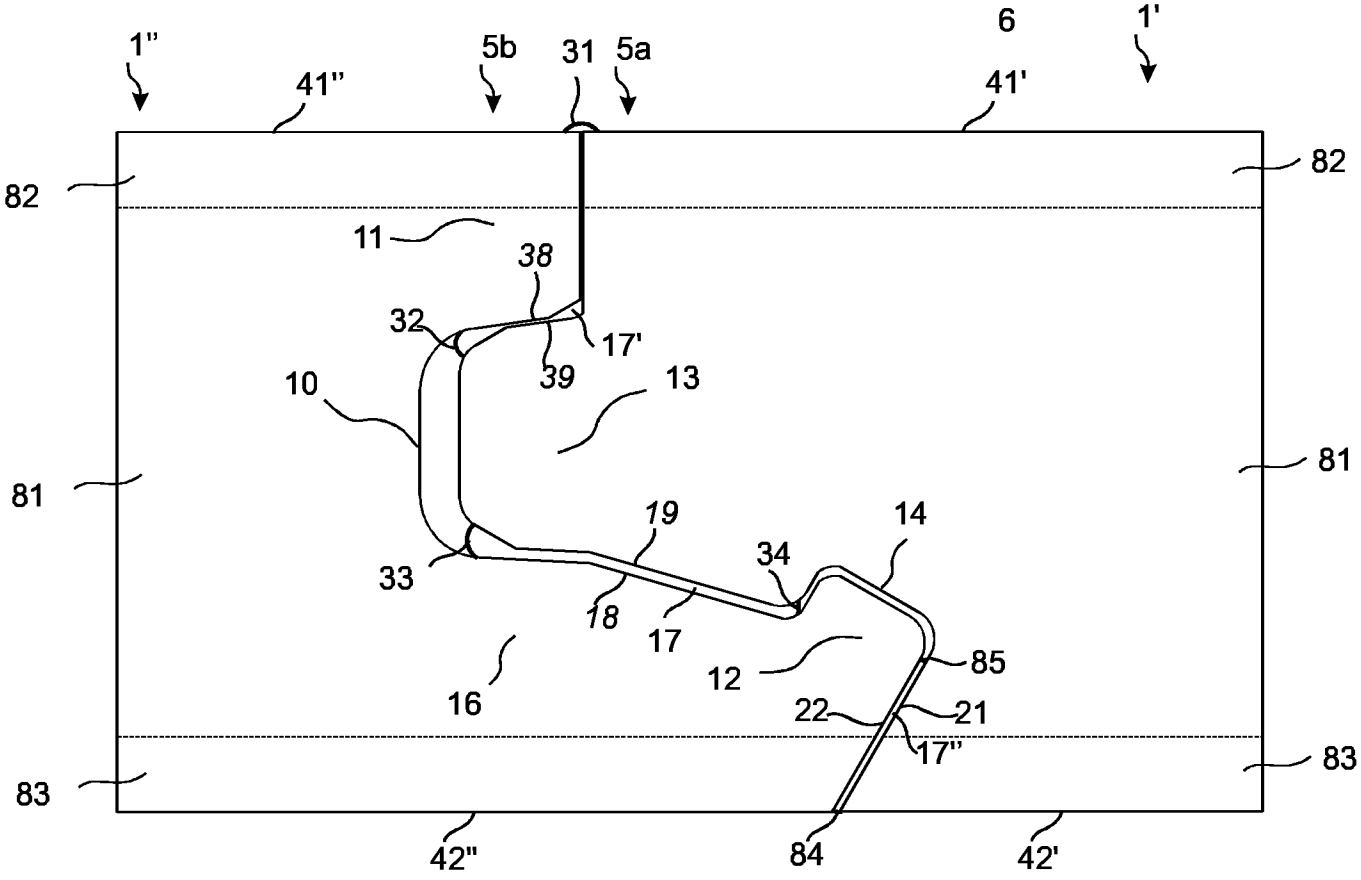
FIG. 8 shows a crosscut in a side view of an embodiment of the set of subfloor panels in a joined position according to an embodiment of the invention.

FIG. 8 shows that the first and the second panel 1', 1" each may comprise outer layers 82, 83 and a core layer 81, wherein the core layer 81 comprises coarser particles than the outer layers, wherein the lower surface 19 of the tongue and the upper surface 18 of the lower lip 16 is within the core layer, such that a stronger glue connection is obtained.

An upper surface 39 of the tongue 13 is configured to be glued to a lower surface 38 of the upper lip 11, wherein the upper surface 39 of the tongue 13 and lower surface 38 of the upper lip 11, is within the core layer 81, such that a stronger glue connection is obtained.

The first impact surface 22 may be configured to be glued to the second impact surface 21. The first impact surface 22 and the second impact surface 21 may be positioned at least partly in the core layer 81. The glue 17" between the first impact surface 22 and the second impact surface 21 may be distributed from a lower portion 84 at the lower surface 42', 42" of the first and the second panel, respectively, to an upper portion 85 adjacent to an upper surface of the element groove 14.

Each of the panels may comprise a decorative layer attached to at least one of said outer layers.

FIG. 4 shows an embodiment of the first panel 1', the second panel 1" and the third panel 1 during assembling on joists 71, 71', 71", 71'". The first panel 1', the second panel 1" and the third panel 1 may also be glued to the joists 71, 71', 71", 71'". The joists 71, 71', 71", 71'" may be wood based. The first panel 1', the second panel 1" and the third panel 1 may be identical.

Figure 5A:
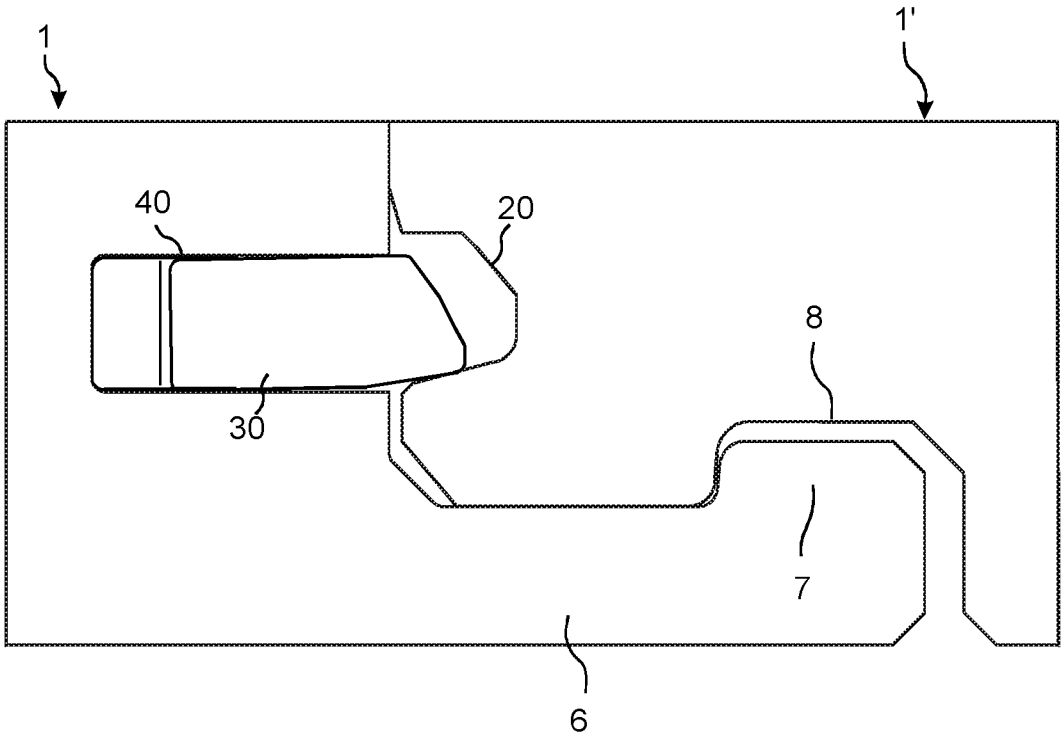
FIGS. 5A-5B show crosscuts in a side view of embodiments of the set of subfloor panels in a joined position according to embodiments of the invention.
Figure 5B:
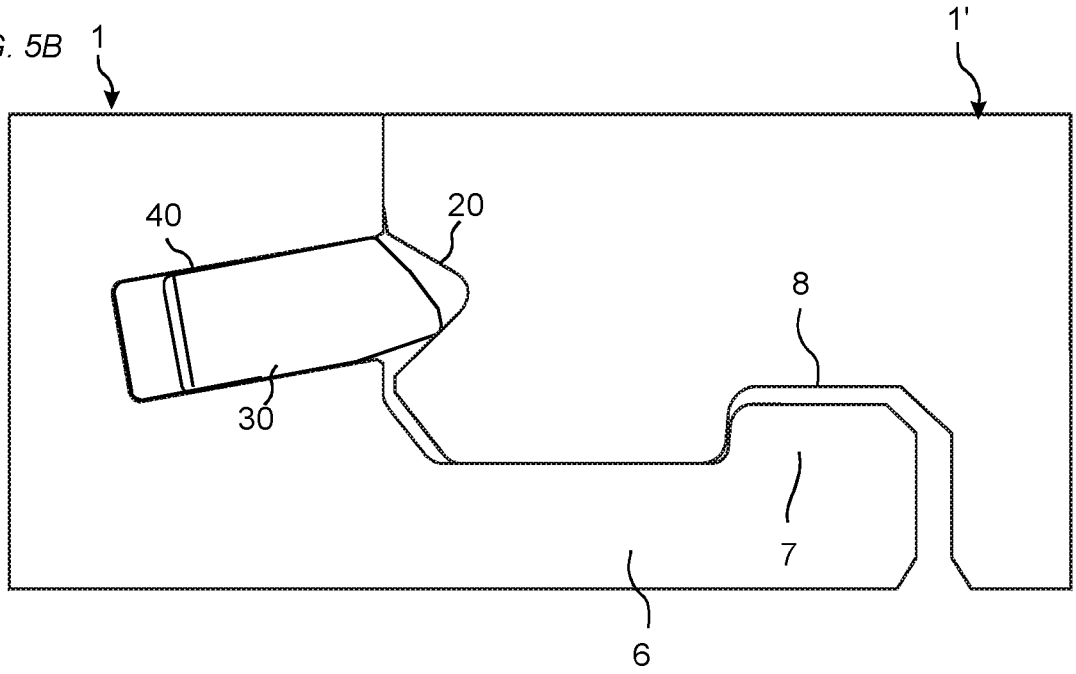

FIG. 5A shows an embodiment of the joint for joining a third edge of the first panel 1' to a fourth edge of a third panel 1. The joint may comprise a flexible tongue 30 at the fourth edge configured to cooperate with a tongue groove 20 at a third edge for positioning of the first panel 1' relative to the third panel 1 in a vertical direction. The flexible tongue 30 may be positioned in a displacement groove 40. The flexible tongue may be configured to be compressed during assembling and spring back towards and partly into the tongue groove 20. The joint may comprise a strip 6 that protrudes from the fourth edge. An outer part of the strip 6 may comprise an element 7 and an underside of the third edge may comprise an element groove 14, wherein the element and the element groove are configured for positioning of the first panel 1' relative to the third panel 1 in a horizontal direction. FIG. 5B shows an embodiment of the joint comprising an embodiment of the displacement groove 40 which extends in an angled direction relative to an upper surface of the third panel. The joint is shown in a joined position. Glue may be applied in the joint before the fourth edge and the third edge are joined.

Figure 6A:
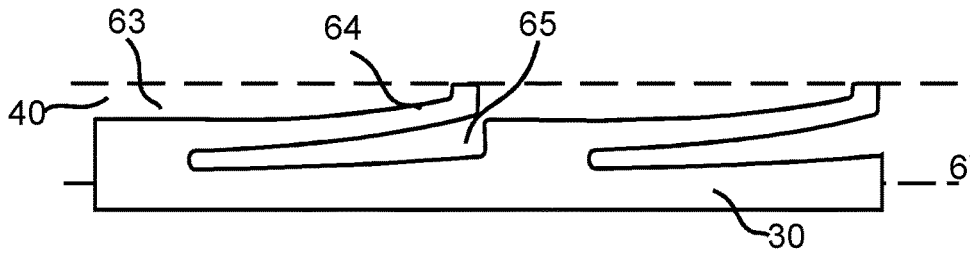
FIGS. 6A-6J show embodiments of a flexible tongue according to embodiments of the invention.
Figure 6B:
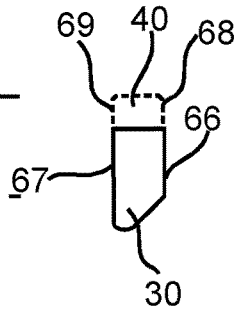
Figure 6C:
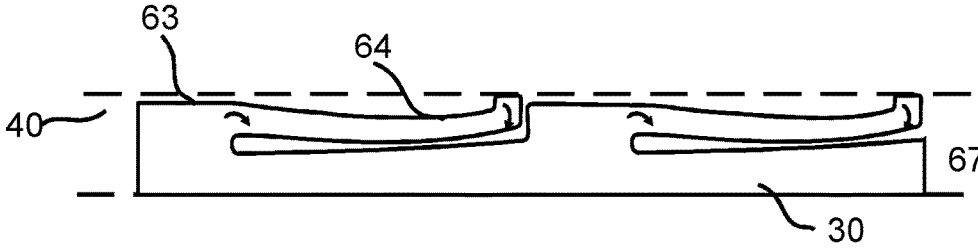
Figure 6D:
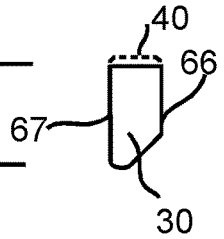

Embodiments of the flexible tongue 30, which is displaceable in the insertion groove 40, are shown in FIGS. 6A-6D. FIGS. 6A-6B show the flexible tongue 30 in a joined position and FIGS. 6C-6D show the flexible tongue 30 during assembling of a panel and an adjacent panel. FIG. 6B shows a cross section of the flexible tongue 30 in FIG. 6A, which shows a top view. FIG. 6D shows a cross section of the flexile tongue 30 in FIG. 6C, which shows a top view. The flexible tongue 30 comprises bendable protruding parts 64. A space 63 is provided between the flexible tongue 30 and a bottom wall of the insertion groove 40. FIG. 6C shows that the flexible tongue 30 is pushed into the insertion groove 40 and towards the bottom wall of the insertion groove 40 during an assembly of a panel with an adjacent panel. The flexible tongue 30 springs back towards its initial position when the panel has reached a joined position. A recess 65 is preferably arranged at each bendable protruding part.

The flexible tongue 30 may have a first displacement surface 66 and an opposite second displacement surface 67, configured to be displaced along a third displacement surface 68 and a fourth displacement surface 69, respectively, of the insertion groove 40.

Figure 6E:
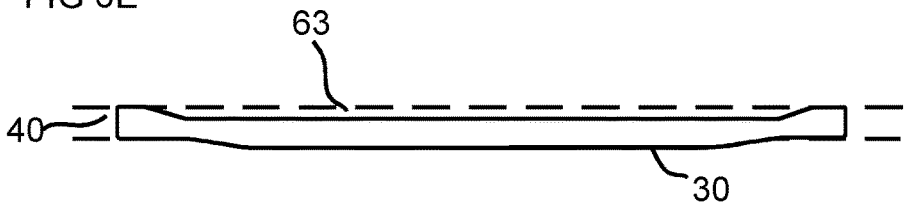
Figure 6F:
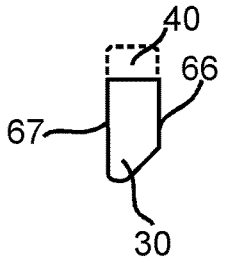

Another embodiment of the flexible tongue 30, without the protruding bendable parts 64, is shown in FIGS. 6E-6F. FIG. 6F shows a cross section of the flexible tongue 30 shown in FIG. 6E, which shows a top view. The alternative embodiment is bendable in the length direction of the flexible tongue 30 in order to accomplish a similar function as the embodiment shown in FIGS. 6A-6D.

Figure 6G:
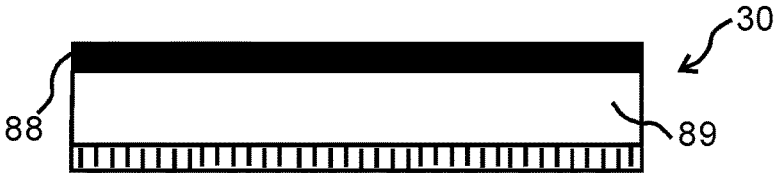

Another embodiment of the flexible tongue 30 is shown in FIG. 6G in a top view. The tongue 30 comprises an inner part 38 and an outer part 39. The inner part 38 and the outer part 39 are preferably made of two different materials, wherein the inner part 38 is more flexible than the outer part 39. The inner part 38 is configured to be inserted into the insertion groove 40 and the outer part 39 is configured to extend into the tongue groove 20.

Figure 6H:
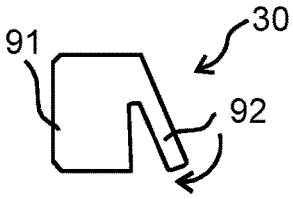
Figure 6I:
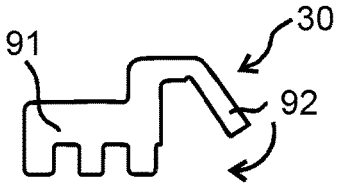
Figure 6J:
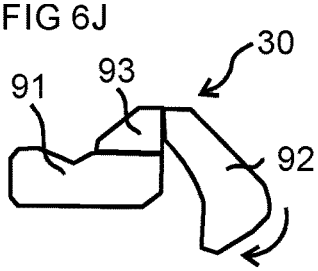

FIGS. 6G-J show cross section embodiments of the tongue 30 comprising an inner part 91 and a pivoting outer part 92. The inner part 91 is configured to be inserted into the insertion groove 40 and the outer part 92 is configured to extend into the tongue groove 20 and pivot during assembly of a panel and an adjacent panel. The embodiments in FIGS. 6H-6I are preferably produced in one material, such as a polymer, by extruding. The embodiment in FIG. 6J is preferably produced by coextruding and comprises at least two different polymer materials. The embodiment comprises a hinge portion 93 which connects the inner part 91 and the outer part 92. The material of the hinge portion 93 is preferably more flexible than the inner part 91 and the outer part 93.

Figure 7:
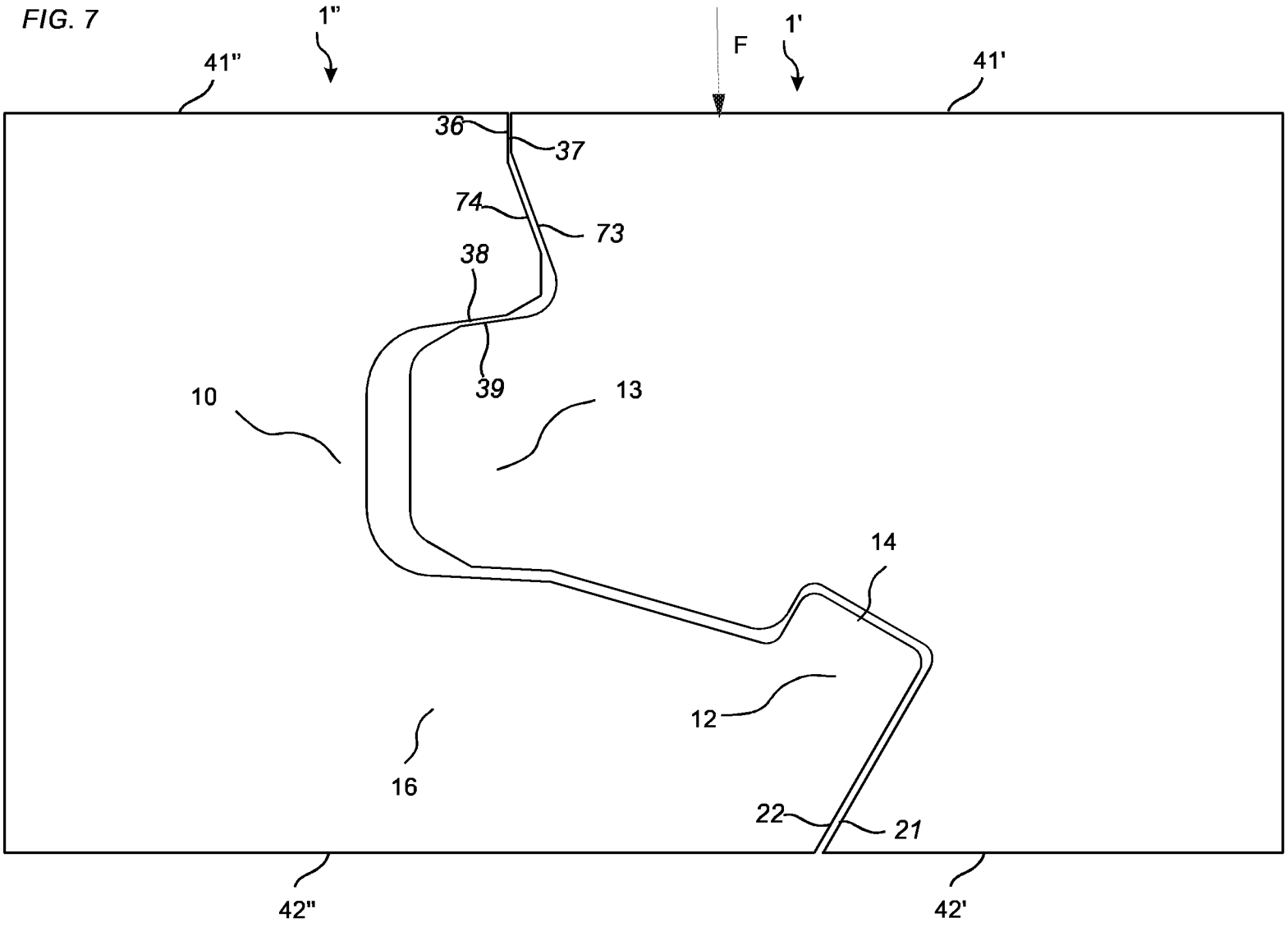
FIG. 7 shows a crosscut in a side view of an embodiment of the set of subfloor panels in a joined position according to an embodiment of the invention.

FIG. 7 shows a crosscut in a side view of an embodiment of the set of subfloor in a joined position. The set comprises a joint configured to be glued. The joint comprises at the first edge a third impact surface 73, which is downward facing, and the second edge comprising a fourth impact surface 74, which is upward facing. The third impact surface 73 is configured to cooperate with the fourth impact surface 74 for partly absorbing a force F applied at an upper surface 41' of the first panel when the first and the second panel are joined by the joint and assembled on joists 71, 71' as shown in FIG. 4. The third impact surface 73 may be positioned between the upper surface 39 of the tongue 13 and the first joint surface 37. The fourth impact surface 74 may be positioned between the upper surface 39 of the tongue 13 and the second joint surface 36.

Embodiments

1. A set of essentially identical subfloor panels (1, 1', 1") comprising a joint configured to be glued, wherein the joint comprises a tongue (13) at a first edge (5*a*) of a first panel (1') and a tongue groove (10) at a second edge (5*b*) of a second panel (1"), wherein the tongue (13) and the tongue groove (10) are configured for positioning of the first panel (1') relative the second panel (1") in a vertical direction, wherein a lower lip (16) of the tongue groove (10) extend beyond an upper lip (11) of the tongue groove (10), wherein an element (12) protrudes from the lower lip (16) and an underside of the first edge (5*a*) comprises an element groove (14), wherein the element and the element groove are configured for positioning of the first panel (1') relative the second panel (1") in a horizontal direction, wherein an outer edge of the lower lip (16) comprises a first impact surface (22), wherein the first impact surface is downward facing, and the first edge (5*a*) comprises a second impact surface (21), wherein the second impact surface is upward facing, and wherein the first impact surface (22) is configured to cooperate with the second impact surface (21) for partly absorbing a force (F) applied at an upper surface (41') of the first panel (1') and/or at an upper surface (41") of a second panel (1") when the first and the second panel are joined by the joint and assembled on joists (71, 71').

2. The set of embodiment 1, wherein a lower surface (19) of the tongue (13) is configured to be positioned at a distance (44) from an upper surface (18) of the lower lip (16), in a joined position of the first and the second panel (1', 1"), such that a glue space is obtained.

3. The set of embodiment 2, wherein the glue space extends essentially from the element (12) to an outer part of the tongue (13).

4. The set of any one of the embodiments 2-3, wherein the distance between the lower surface (19) of the tongue (13) and the upper surface (18) of the lower lip (16), is in the range of about 0.2 mm to about 0.5 mm, preferably about 0.3 mm.

5. The set of any one of the embodiments 1-4, wherein an angle (43) between the second impact surface and a lower surface (42') of the first panel (1') is in the range of about 40° to about 70°, preferably about 60°.

6. The set of embodiment 5, wherein the first impact surface (22) is essentially parallel to the second impact surface (21).

7. The set of any one of the embodiments 1-6, wherein the first panel (1') and the second panel (1") are wood based panels, such as particleboard, OSB, plywood, HDF or MDF.

8. The set of embodiment 7, wherein the first and the second panel (1', 1") each comprises outer layers (82, 83) and a core layer (81), wherein the core layer (82) comprises coarser particles than the outer layers, and wherein the lower surface (19) of the tongue and the upper surface (18) of the lower lip (16) is within the core layer.

9. The set of embodiment 7 or 8, wherein the first and the second panel (1', 1") each comprises outer layers (82,83) and a core layer (81), wherein the core layer (81) comprises coarser particles than the outer layers (82,83), wherein an upper surface (39) of the tongue (13) is configured to be glued to a lower surface (38) of the upper lip (11), and wherein the upper surface (39) of the tongue (13) and lower surface (38) of the upper lip (11), are within the core layer (82).

10. The set of any one of the embodiments 1-9, wherein the joint is configured for a joining of the first edge (5*a*) and the second edge (5*b*) by an angling motion (50) of the first panel (1') relative to the second panel (1").

The invention claimed is:

1. A set of subfloor panels each comprising a joint configured to be glued, wherein the joint comprises a tongue located at a first edge of a first panel and a tongue groove located at a second edge of a second panel, wherein the tongue and the tongue groove are configured for positioning of the first panel relative to the second panel in a vertical direction, wherein a lower lip of the tongue groove extends beyond an upper lip of the tongue groove, wherein an element protrudes from the lower lip and an underside of the first edge comprises an element groove, wherein the element and the element groove are configured for positioning of the first panel relative to the second panel in a horizontal direction, wherein an outer edge of the lower lip comprises a first impact surface, wherein the first impact surface is downward facing, and the first edge comprises a second impact surface, wherein the second impact surface is upward facing, wherein the first impact surface is configured to cooperate with the second impact surface to partly absorb a force applied at least at one of (a) at an upper surface of the first panel or (b) at an upper surface of a second panel in a joined position of the first and the second panel by the joint and positioned on joists, and wherein a lower surface of the tongue is configured to be positioned at a distance from an upper surface of the lower lip, in the joined position of the first and the second panel, such that a glue space is obtained between parallel respective surfaces of the lower surface of the tongue and the upper surface of the lip.

2. The set of claim 1, wherein the glue space extends from the element to an outer part of the tongue.

3. The set of claim 1, wherein the joint is configured for a joining of the first edge and the second edge by an angling motion of the first panel relative to the second panel.

4. The set of claim 1, wherein the distance between the lower surface of the tongue and the upper surface of the lower lip, is in a range of about 0.2 mm to about 0.5 mm.

5. The set of claim 1, wherein a distance between the first impact surface and the second impact surface is in a range of about 0.05 mm to about 0.3 mm.

6. The set of claim 1, wherein a distance between the first impact surface and the second impact surface is in a range of about 0.1 mm to about 0.2 mm.

7. The set of claim 1, wherein an angle between the second impact surface and a lower surface of the first panel is in a range of about 40° to about 70°.

8. The set of claim 7, wherein the first impact surface is parallel to the second impact surface.

9. The set of claim 1, wherein the first panel and the second panel are wood based panels.

10. The set of claim 9, wherein the first and the second panel each comprises outer layers and a core layer, wherein the core layer comprises coarser particles than the outer layers, and wherein the lower surface of the tongue and the upper surface of the lower lip are within the core layer.

11. The set of claim 9, wherein the first and the second panel each comprises outer layers and a core layer, wherein the core layer comprises coarser particles than the outer layers, wherein an upper surface of the tongue is configured to be glued to a lower surface of the upper lip, and wherein the upper surface of the tongue and lower surface of the upper lip, are within the core layer.

* * * * *